United States Patent [19]

Holland et al.

[11] Patent Number: 4,641,343

[45] Date of Patent: Feb. 3, 1987

[54] REAL TIME SPEECH FORMANT ANALYZER AND DISPLAY

[75] Inventors: George E. Holland; Walter S. Struve; John F. Homer, all of Ames, Iowa

[73] Assignee: Iowa State University Research Foundation, Inc., Ames, Iowa

[21] Appl. No.: 468,463

[22] Filed: Feb. 22, 1983

[51] Int. Cl.[4] ..... G10L 7/10

[52] U.S. Cl. ..... 381/48; 434/185

[58] Field of Search ..... 381/41, 42, 43, 44, 381/45, 46, 47, 48, 49, 50, 36–53; 364/513, 513.5; 434/169, 185

[56] References Cited

U.S. PATENT DOCUMENTS

| | | | |
|---|---|---|---|
| 2,212,431 | 8/1940 | Bly | 35/1 |
| 2,416,353 | 2/1947 | Shipman et al. | 35/1 |
| 2,487,244 | 11/1949 | Horvitch | 35/35 |
| 3,043,913 | 7/1962 | Tomatis | 179/1 |
| 3,881,059 | 4/1975 | Stewart | 381/48 |
| 3,946,504 | 3/1976 | Nakano | 35/35 C |
| 4,039,754 | 8/1977 | Lokerson | 381/48 |
| 4,063,035 | 12/1977 | Appelman et al. | 381/48 |
| 4,075,423 | 2/1978 | Martin et al. | 381/50 |
| 4,335,276 | 6/1982 | Bull et al. | 381/48 |
| 4,406,626 | 9/1983 | Anderson et al. | 381/50 |

OTHER PUBLICATIONS

Flanagan, Speech Analysis Synthesis and Perception, Springer-Verlag, New York, 1972, pp. 192–199.

"Preliminary Work with the New Bell Telephone Visible Speech Translator" *American Annals of the Deaf,* vol. 113, No. 2, Mar. 1968, Stark, R. E. et al. pp. 205–214.

"Visual Aids For Speech Correction" *American Annals of the Deaf,* vol. 113, No. 2, Mar. 1968, Risberg, A., pp. 178–194.

"The Voice Visualizer" *American Annals of the Deaf,* vol. 113, No. 2, Mar. 1968, Pronovost, et al. pp. 230–238.

"Teaching of Intonation of the Deaf by Visual Pattern Matching" *American Annals of the Deaf,* vol. 113, No. 2, Mar. 1968, Phillips, N. D., et al., pp. 239–246.

"Instantaneous Pitch-Period Indicator" *The Journal of th Acoustical Society of America,* vol. 27, No. 1, Jan. 1955, Dolansky, L. O., pp. 67–72.

"An Experimental Pitch Indicator for Training Deaf Scholars" *The Journal of the Acoustical Society of America,* vol. 32, No. 8, Aug. 1960, Anderson, F. pp. 1065–1074.

*Primary Examiner*—Thomas M. Heckler
*Assistant Examiner*—John J. Salotto
*Attorney, Agent, or Firm*—Zarley, McKee, Thomte, Voorhees & Sease

[57] ABSTRACT

A speech analyzer for interpretation of sound includes a sound input which converts the sound into a signal representing the sound. The signal is passed through a plurality of frequency pass filters to derive a plurality of frequency formants. These formants are converted to voltage signals by frequency-to-voltage converters and then are prepared for visual display in continuous real time. Parameters from the inputted sound are also derived and displayed. The display may then be interpreted by the user. The preferred embodiment includes a microprocessor which is interfaced with a television set for displaying of the sound formants. The microprocessor software enables the sound analyzer to present a variety of display modes for interpretive and therapeutic used by the user.

5 Claims, 19 Drawing Figures

6p AMPS LM 301
CALCULATED VALUES BELOW CHOOSE SERIES AND PARALLEL COMBINATIONS
APPROXIMATE R1 & R5 VALUES USE TWO 15K IN PARALLEL FOR R5 SLOTS 6,9

| SLOT | R1 | R5 | R8 | R20 | R24 | FORMATS |
|---|---|---|---|---|---|---|
| 6 | 3917 | 7519 | 1990 | 1990 | 3858 | F1 |
| 7 | 1550 | 25K | 1990 | 1990 | 1555 | F1 |
| 8 | 4.21K | 25.6K | 2274 | 2274 | 64K | F2 |
| 9 | 15K | 7.52K | 2274 | 2274 | 25.9K | F2 |
| 10 | 4434 | 7517 | 3980 | 3980 | 3856 | F0 |
| 15 | 1300 | 25.6K | 3980 | 3980 | 1555 | F0 |

Note: All KYEQ (*) Return to Entry

REAL TIME SPEECH FORMANT ANALYZER AND DISPLAY

GRANT REFERENCE

This invention was made in part under Department of Energy Contract No. W-7405 ENG-82.

BACKGROUND OF THE INVENTION

1. Field of Invention

This invention relates to a speech analyzer used for interpretation purposes, more particularly the use of a speech analyzer for visual feed-back therapy for the aurally handicapped or the speech-impaired.

2. Description of the Prior Art

Sound is generated and sustained by the mechanical displacement of matter. Sound is carried through the air by this periodic molecular vibration, each sound having its unique vibrational frequency.

Human speech, created by vibration of the vocal chords, propagates sound in this manner. Research has shown that each particular sound associated with a vowel or consonant (or any combination thereof) has its own unique frequency pattern. Speech is thus learned by hearing and experimentally repeating sounds and words to formulate a language.

Aurally handicapped people do not have the luxury of being able to "hear" the frequencies of speech and, by trial and error, try to reproduce them. Therefore, there is a great need to have a system which would allow aurally handicapped people to be able to perceive their speech so that it can be analyzed, interpreted, and improved.

Various attempts have been made to solve this problem, most centering on some type of visual feed-back mechanism as an interpretive medium. Some attempts sought to show the general frequency speech form on an oscilloscope or a like instrument. These devices showed only the raw speech spectrum and did not provide adequate information to develop needed teaching of speech.

Other attempts have utilized complex circuitry, which makes them impractical for general use and requires specially trained assistants to interpret and use the equipment.

Therefore, a simple, visual feed-back mechanism is important to allow deaf people to interpret their own sounds and learn to speak. Of the devices marketed at this time, problems exist in that some have a very complex display to interpret, while others have poor frequency resolution which prevents accurate interpretation.

Cost and availability are also major problems. In order for the sound analyzer to be widely effective, it must be economical and user-oriented.

This invention is related to the co-pending application by Messrs. Holland and Struve, entitled SOUND ANALYZER, Ser. No. 430,772 now abandoned, and improves upon that application by expanding the flexibility and uses to which the device can be applied. By the addition and expansion of electronic circuitry and the utilization of a small computer, and video terminal with attendant modifiable software programming, users have a wide variety of optional, selectable, formats by which they can interpret speech and sounds.

It is therefore an object of this invention to provide a real time speech formant analyzer and display which presents a comprehensive system for the visual analyzation and interpretation of speech and sounds.

Another object of this invention is to provide a real time speech formant analyzer and display which is easy to operate and easy to interpret.

Another object of this invention is to provide a real time speech formant analyzer and display which provides multiple, flexible modes, each being selectable by the user for particular use.

A further object of this invention is to provide a real time speech formant analyzer and display which is expandable in its modes and uses according to desired software programming.

A further object of this invention is to provide a real time speech formant analyzer and display having a visual feed-back mechanism to allow aurally handicapped people to interpret their own sounds and learn to speak.

Another object of this invention is to provide a real time speech formant analyzer and display which provides useful information concerning speech and sound in readily usable forms.

A further object of this invention is to provide a real time speech formant analyzer and display which enables individual operation and use or concurrent use with a teacher or another person.

A further object of this invention is to provide a real time speech formant analyzer and display which runs on continuous time and has sharp frequency resolution for distinguishing sounds.

Another object of this invention is to provide a real time speech formant analyzer and display which displays sounds in continuous real time in two-dimensional space and is easily visualized.

Another object of this invention is to provide a real time speech formant analyzer and display which is economical.

Additional objects, features and advantages of the invention will become apparent with reference to the accompanying specification and drawings.

SUMMARY OF THE INVENTION

This invention utilizes electronic circuitry which converts sound into a visually interpretable display. The invention consists of a sound input, formant filters which convert the sound into three formants, frequency-to-voltage converters for these formants, a display-readying output circuitry, a small computer, and finally, a display screen.

The preferred use of the invention is as a speech analyzer, utilizing its circuitry to derive frequency formants by selective filtering, converting these formants to voltages and then plotting them orthogonally on the display unit. An ideal plot of speech sounds can be mapped and a template can be inserted on the display screen to help the user "target" his speech to match the ideal sound.

The sound input consists of a microphone having good isolation properties so that extraneous sounds are prevented from entering the circuitry.

The filters divide the sound signal into three formants, two selected from the lower ranges of the human speech frequency spectrum, the other from the higher ranges. These formants do overlap in frequencies, though, so that no gaps exist. The frequencies of each formant are converted to proportional voltages by circuitry which includes a zero crossing detector. This zero crossing detector emits a pulse upon every zero crossing of the frequency wave from which is derived the proportional voltage.

The voltage signals are prepared for output to a microprocessor which has the capability to perform a variety of functions with the inputted formant signals. The microprocessor is interfaced with a display screen and a control keyboard. The display screen may be a color television set or a computer video terminal integral with the microprocessor. The software programming associated with the device allows the user to key in different program modes for visual display upon the display screen. These modes consist of presenting visual traces upon the screen derived from the sound inputted into the unit by the user or otherwise.

Examples of the different modes include continuous real time display of movable dots representing vowel sounds inputted by the user. A background of targets (entered from the keyboard, by cassette, or stored from previously voiced inputs), can be displayed to aid the user in pronouncing the sounds correctly. Another example would allow the trace of the inputted sound to be held upon the screen for study. A compare mode would allow a saved pattern to be held upon the screen while a second inputted sound would be traced out in another color. Additionally, auxiliary information can be entered into the system via cassette tape, such as prompting messages to help the student use the system, or cassette entered "games" would allow one or more persons to use voice sounds to compete with each other by interacting with games on the screen.

Additionally, the sound analyzer filter characteristics can be such that one, two or more tone "listening" can easily be accomplished. A simple program can be written to interpret this tonal sound and display information derived from it. Examples of this use includes telephone ringing, doorbells, fire alarms, morse code and a baby crying.

Additional parameters may be used concurrently with the formants derived from the sound, an example being a loudness parameter which is displayed by a bar graph upon the television screen.

A preferred embodiment of the invention produces a trace of at least two of the formants, plotting them orthogonally with respect to each other, and running on continuous time. The displayed trace is a visual representation of the speech which entered the sound input microphone, and allows the user to interpret and therapeutically use the display.

In accordance with another aspect of the invention, more than two formants can be derived which can supply additional information to the display.

The sound analyzer may also be used for other useful and beneficial purposes not necessarily associated with hearing impaired persons. It can be employed with great educational benefit, to teach mentally handicapped persons to speak better, to help those with specific speech problems (such as lisps or stuttering) to overcome those problems, and to aid foreign language students (or foreigners) to better assimilate to a language. Voice-recognition uses are also possible, lending the invention valuable for many other useful applications. Security systems can be constructed to screen persons according to their speech. Recorded voices could be identified by direct comparison with the speaker, which has broad application in legal fields. These are only a few of the possibilities to which the invention could be put to use.

DETAILED DESCRIPTION OF THE PREFERRED EMBODIMENT

Figure 1:
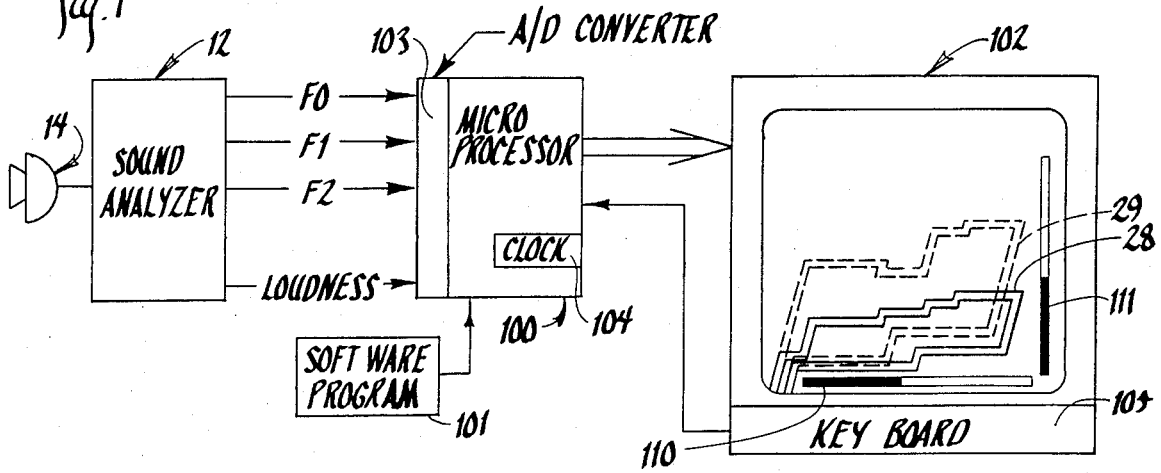
FIG. 1 is a generalized block diagram of the invention.

In reference to the drawings, and particularly FIG. 1, there is shown a sound analyzer system having a sound analyzer circuitry 12 with a microphone input 14, a microprocessor or small computer 100 with specialized software 101, and television 102 for displaying a visual representation or trace 28 of the input sound for interpretation by the user.

FIG. 1 shows the sound analyzer 12 being of such a construction as to derive a plurality of formants F0 through F2, and a parameter entitled "loudness", which are inputted into small computer 100 which is programmed to present the inputted information in a useful form to television unit 102. (Television unit 102 could alternatively be a video terminal).

Formant F0 comprises a frequency range of approximately 0–200 hertz. The natural variations of pitch between the voices of men, women and children are contained within this 0–200 hertz range. The display trace 28 (containing formants F1 and F2) for men, women and children is exhibited in generally the same location upon television unit 102. Comparisons between voices of different pitch can therefore be made because a trace 28 of a lower-in-pitch voice will be displayed in the same general area as the trace 28 of a middle or higher pitched voice. Formant F0 can then be used as a parameter and displayed concurrently in a vertical bar graph 111 or some other indicia upon television unit 102, to show the user or observers the pitch of the input sound. Formant F0 does contain valuable sound information, and therefore may also be optionally included in trace 28.

A loudness parameter is also derived by monitoring the amplitude of the input sound. Loudness may therefore also be displayed on television unit 102 by means of a horizontal bar graph 110 to provide the user with information on the loudness of the input sound. Numeral 29 designates the ghost lines in FIG. 1 which represent a trace of speech previously inputted into microphone 14 and sound analyzer 12 by an instructor or other person and held on display as F1 and F2 on television 102 for comparison to trace 28.

Small computer 100 is of a standard configuration known to the art and must include A/D converter 103, programming capabilities, memories, and other capabilities of standard microprocessors, such as software clock 104 timing for sampling. Keyboard 105 controls the interaction of small computer 100 and the television display unit 102, thereby greatly increasing the functionality of the sound analyzer and simplifying operation by the user.

The A/D converter 103 simply interfaces the output of the frequency filter circuitry to the small computer 100, while the memory, software clock 104, keyboard 105, and television display unit 102 are all devices which can be selected according to desired needs and uses and are all known in the art. Examples of the programming capabilities are discussed elsewhere.

Traces 28 and 29 can be continuous time orthogonal plots of formant F1 and formant F2. These formants F1 and F2 are derived respectively from frequency filter circuitry in sound analyzer 12.

Figure 2:
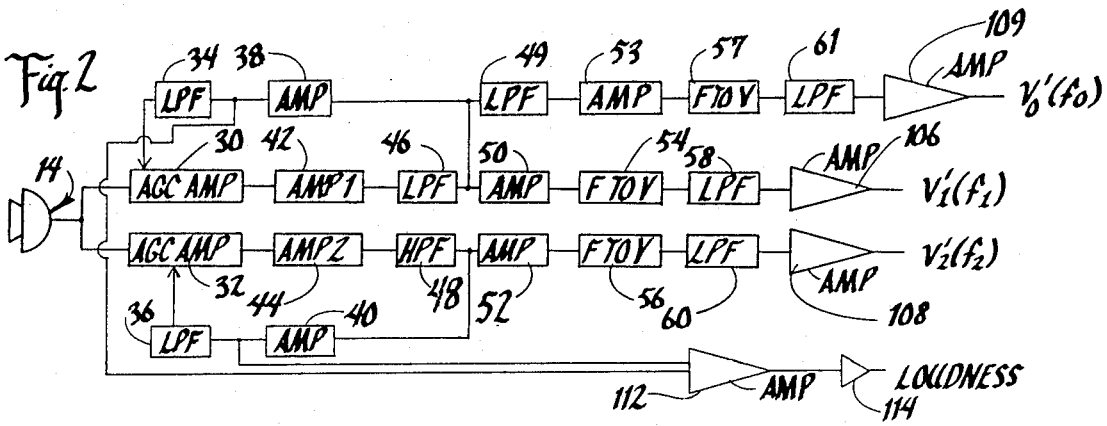
FIG. 2 is a block diagram of the sound analyzer circuitry of the invention.

The circuitry of sound analyzer 12 is more specifically set out in FIG. 2. The output from microphone 14 is connected in parallel to automatic gain control amplifiers (AGC amps) 30 and 32. These AGC's 30 and 32 can combine with low pass filters 34 and 36 and amplifiers 38 and 40 to provide an automatic gain control circuit which supplies a substantially constant output of signal amplitude over a range of variation at the input. This AGC circuit automatically insures that a desired input signal is "picked up" by the circuitry. It converts a very weak input signal into one of sufficient amplitude for processing by referencing the voltage signals after filters 46 and 48. This referenced signal is amplified by amplifiers 38, 40, is averaged by low pass filters 34, 36, and then inputted back into AGC amplifiers 30, 32. If the reference signal is very weak, the AGC amplifiers 30 and 32 boost the parallel input signals so that they are of sufficient amplitude to derive the necessary information from them. This AGC circuitry is tailored to respond at a level deemed to be appropriate. When the reference signals are of a sufficient level for accurate processing by the sound analyzer circuitry, the AGC amplifiers 30 and 32 do not boost the input signals. An example of the operation of the AGC amplification circuitry, showing its advantages, is a situation where the speaker is too far away from the microphone, thereby rendering the input signal weak and of a low amplitude. Instead of losing this information, or having the information misinterpreted, the automatic gain control circuitry detects the weak reference outputs after filters 46 and 48 and almost instantaneously turns on AGC amplifiers 30 and 32 so that the weak input sound is amplified for processing. This feature greatly increases the ease of use and functionality of the invention, allowing the circuitry to function without undue problems associated with extraneous technicalities, such as exact microphone positioning.

Figure 3:
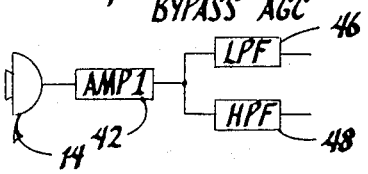
FIG. 3 is a partial block diagram of the sound analyzer circuiit of FIG. 2 with the AGC circuitry bypassed.

Alternatively, the AGC circuitry can be bypassed. This is shown schematically in FIG. 3 and diagrammatically in FIG. 7 by dashed lines. In this embodiment, the sound is inputted into microphone 14, which converts the sound to an electrical signal which is introduced into amplifier 42, after which the boosted signal is split into parallel channels. One channel enters low pass filter 46, while the other channel enters high pass filter 48, which accomplish the same function as they are the same filters as filters 46 and 48 of FIG. 2. The circuitry following filters 46 and 48 of FIG. 3 is operatively the same as the circuitry following filters 46 and 48 as shown in FIG. 2, excepting the AGC circuitry discussed above. One reason the AGC circuitry might be bypassed is that the gain of microphone 14 may be suitably adjusted for most users, thereby eliminating the need for the AGC amplifiers.

Referring again to FIG. 2, after passing through AGC amplifiers 30 and 32, the signals are then fed into amplifiers 42 and 44 which further boost the signals.

These amplified input signals are then each processed by formant filters 46 and 48 which produce two frequency formants. Filter 46 is a low pass filter (LPF) passing frequencies in the range of 0 to 850 hertz. Filter 48 is a high pass filter (HPF) passing frequencies in the range of 600 to 3000 hertz. Both filters 46 and 48 are high resolution filters and have extremely accurate and sharp cut-offs. Filters 46 and 48 give good separation of frequency bands with very little cross-coupling terms. The circuitry is quite simple and can easily be adapted to large scale integration. Low pass filter 46 response is linear from 100 hertz to 850 hertz. At 850 hertz, the output drops to 0 and then there is a slight peak at 890 hertz. To simplify the filter design, the response of low pass filter 46 can go from 0 to 850 hertz. This avoids having to add components which produce a sharp cut-off at 100 hertz and subsequently produce linear response up to 850 hertz. High pass filter 48 response is linear from 600 hertz to 3000 hertz. Alternatively, high pass filter 48 can be modified to have a response from 600 to 2000 hertz by switching. Low pass filter 49 takes the signal coming out of low pass filter 46 and filters it, passing the frequency formant of approximately 0–200 hertz.

Figure 4:
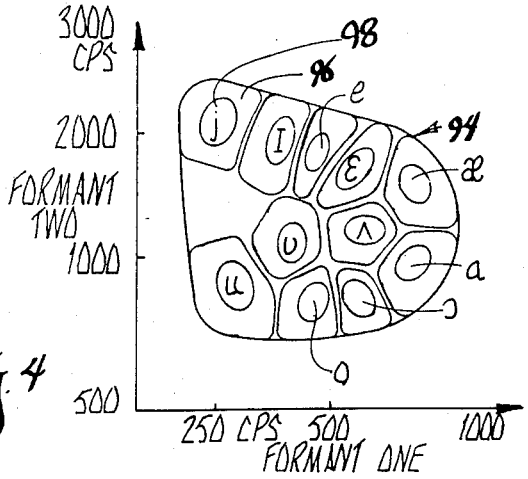
FIG. 4 is a graph of the locations of certain vowel sounds in accordance with the orthogonal plot of formants F1 and F2 in acorrdance with the invention.

In FIG. 4 of the drawings, there is shown a graph of two frequency formants which correspond with the teachings of a book by G. Fairbanks, *Voice and Articulation Drill Book,* 2d Edition (Harper and Row, New York 1959). At page 22, Fairbanks teaches that vowels in particular are characterized by the combination of their formant frequencies, and his findings showed that formants F1 and F2, as set out on the graphs are particularly important. The two dimensions of the plane, corresponding with the X and Y axes, are the frequency ranges of the formants in cycles per second (CPS). Reference numeral 94 points to the general "vowel area" wherein a majority of the vowel sounds are located. Taking into consideration differences between different speakers and their speech, reference numeral 96 refers to a general single vowel area, into which most people speaking that vowel sound should have a plot of formants F1 and F2 fall. Fairbanks found that an ideal voicing of a particular vowel sound would fall into the target area 98. This invention represents the first real time utilization of the principle.

By using extremely high resolution filters 46, 48 and 49, and by utilizing the extremely fast response time of the sound analyzer 12 circuitry, high accuracy in plotting sounds in target areas such as shown in Fairbanks is accomplished by the invention.

The signal passing through low pass filter 46 shall be designated as frequency formant F1 whereas the signal passing through high pass filter 48 shall be designated as frequency formant F2, just as the signal passing through low pass filter 49 is frequency formant F0. After being boosted by amplifiers 50, 52 and 53, these formants pass into frequency to voltage converters 54, 56 and 57, which utilize circuitry to detect zero crossings of each frequency formant signal to derive proportional voltages corresponding with those frequencies. This circuitry can comprise Schmitt triggers which emit a preset pulse for each positive going zero crossing of the frequency formants. These pulses are then integrated by low pass filters 58, 60 and 61 to derive proportional analog voltages. This is done in continuous real time rendering the information virtually instantaneous; there being less than a two millisecond averaging taking place. The "averaging" is, in effect, the circuits' ability to represent the frequency formants with proportional analog voltages. This averaging is done continuously, and the faster the circuit accomplishes this process, the more instantaneous and thus, the more valuable, the output becomes. The faster the response, the closer to "real time" representation of the speech or sounds is accomplished, thereby allowing more interpretable visual representations of the speech or sounds. This extremely fast circuit response is in direct contrast to some prior art where many times there is up to 60 millisecond averaging which results in the aliasing or loss of crucial frequency information.

The proportional voltage signals coming from low pass filters 58, 60 and 61 then pass to amplifiers 106, 108 and 109 which serve to boost the output signals and prepare them for processing by small computer 100. These amplified signals are designated by $V_o'(f_o)$, $V_1'(f_1)$, $V_2'(f_2)$, indicating that these voltages or analog signals are functions of the frequency content of the sound which was introduced into microphone 14. Analog-to-digital converter 103 converts these analog output signals to digital signals for utilization by small computer 100.

Small computer 100 can be a standard home computer as is known in the art such as an Interact, Atari, Apple II, Commadore, or small IBM computer.

Small computer 100 includes software which will process the information obtained from the sound analyzer 12 circuitry to present it in a form which can be beneficially displayed upon television display 102.

Figure 11:
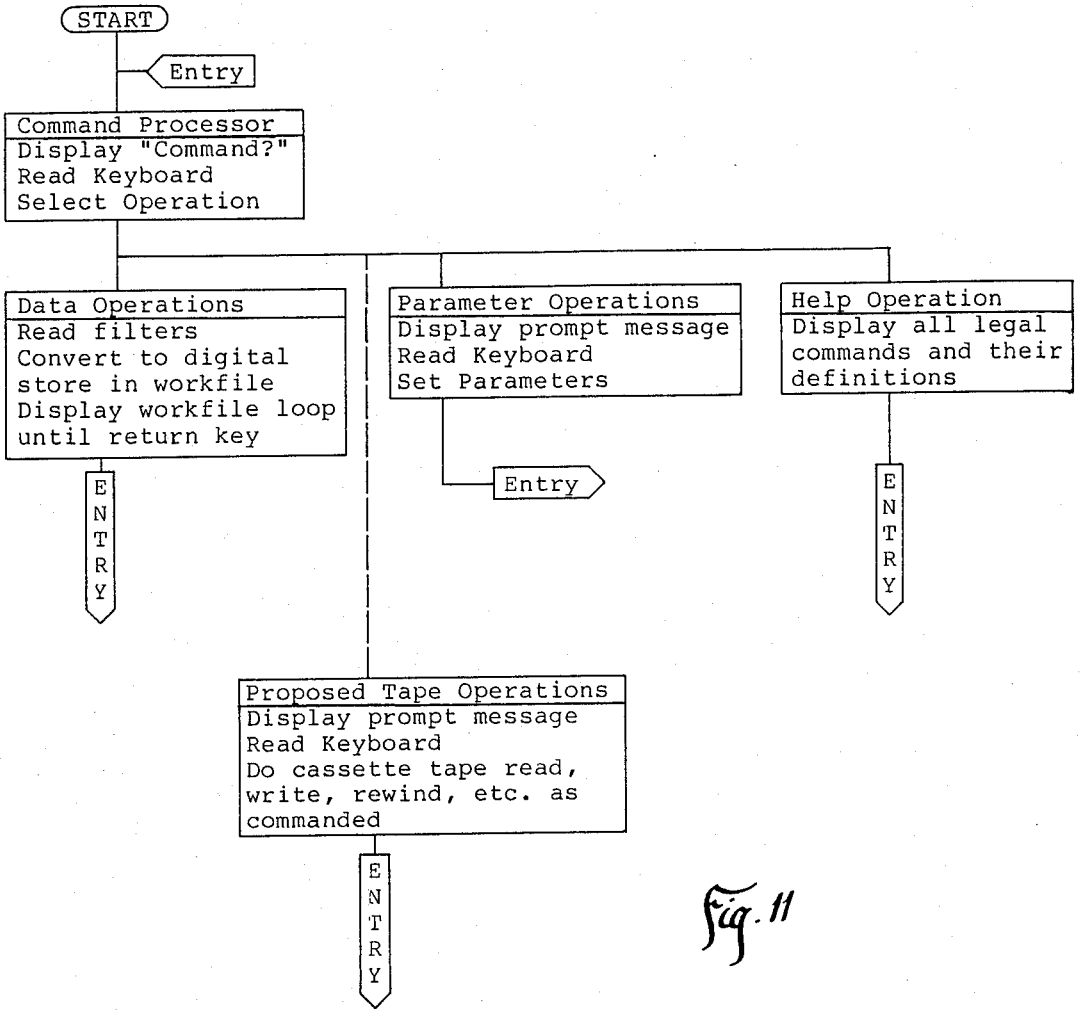
FIGS. 11–14 are a flow diagram of the operation of the small computer which processes the signals from the circuitry for display.

The software operations are generally set out in FIGS. 11–14 which is a flow chart of the basic program design. FIG. 11 is a flow chart representation of the preliminary operations of the invention. The user may choose to initialize data operations, set parameters, get a listing of all commands, or initiate the tape operations which allow the user to perform various functions with respect to a cassette tape.

Figure 12:
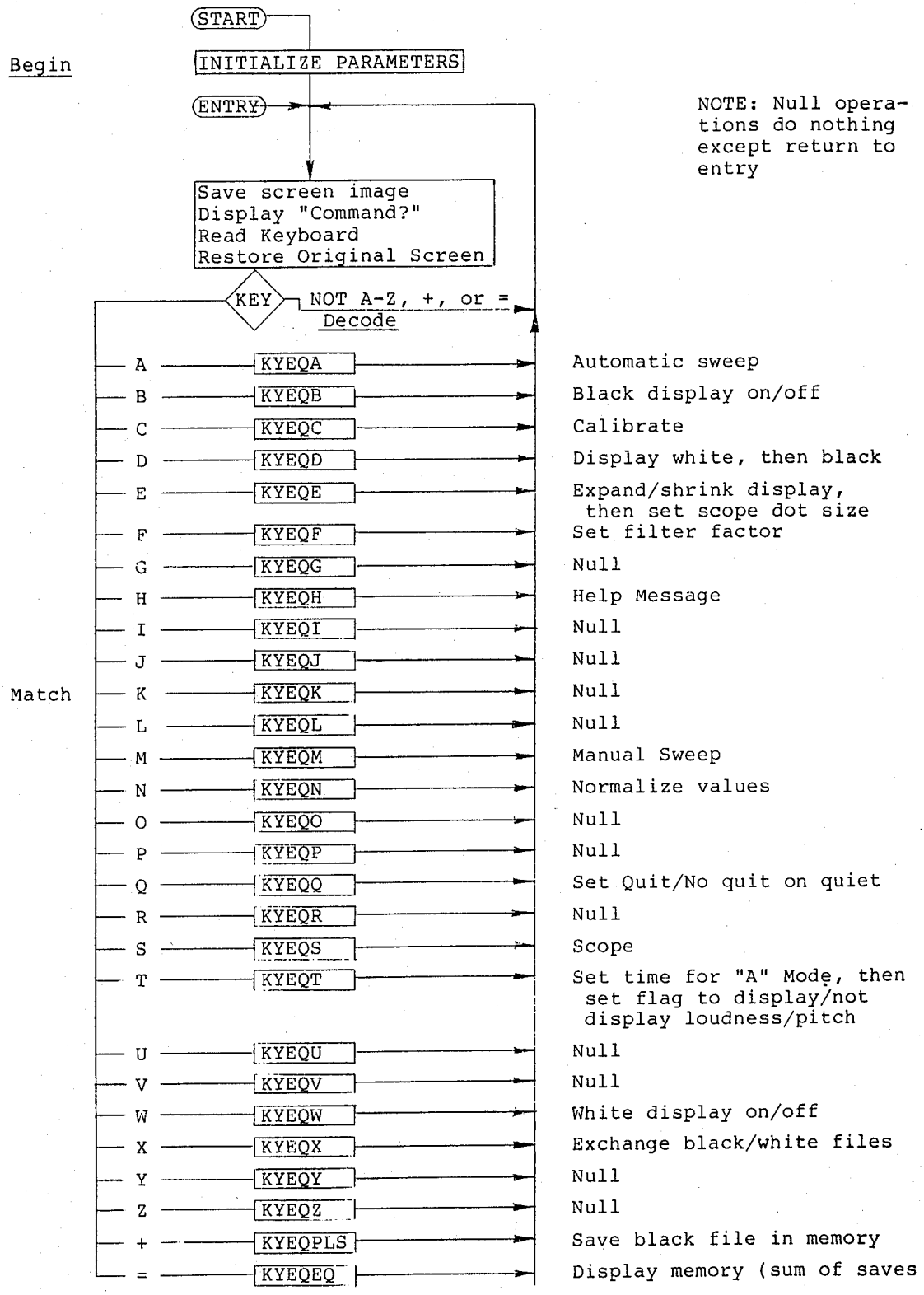
Figure 13:
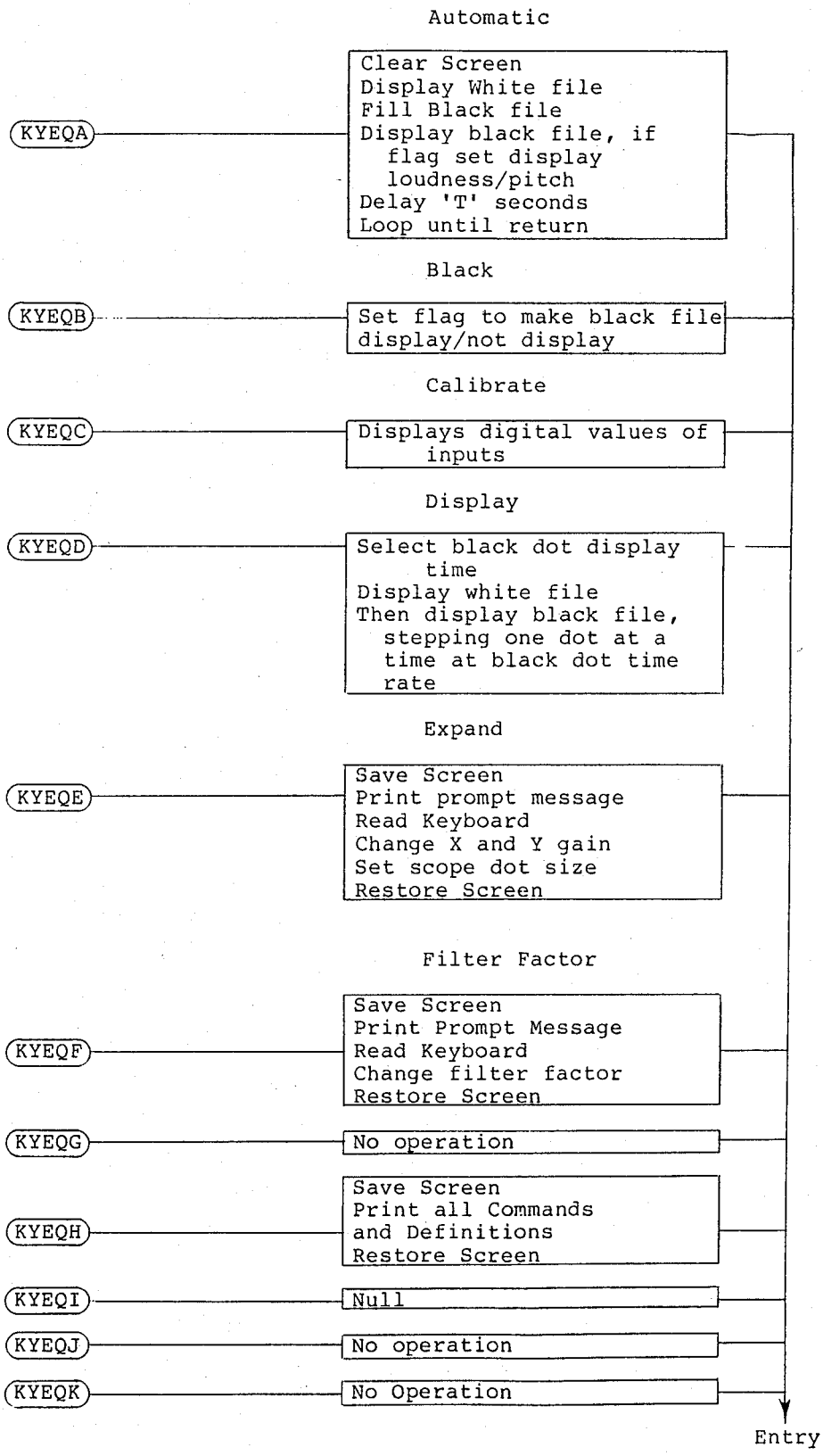
Figure 14:
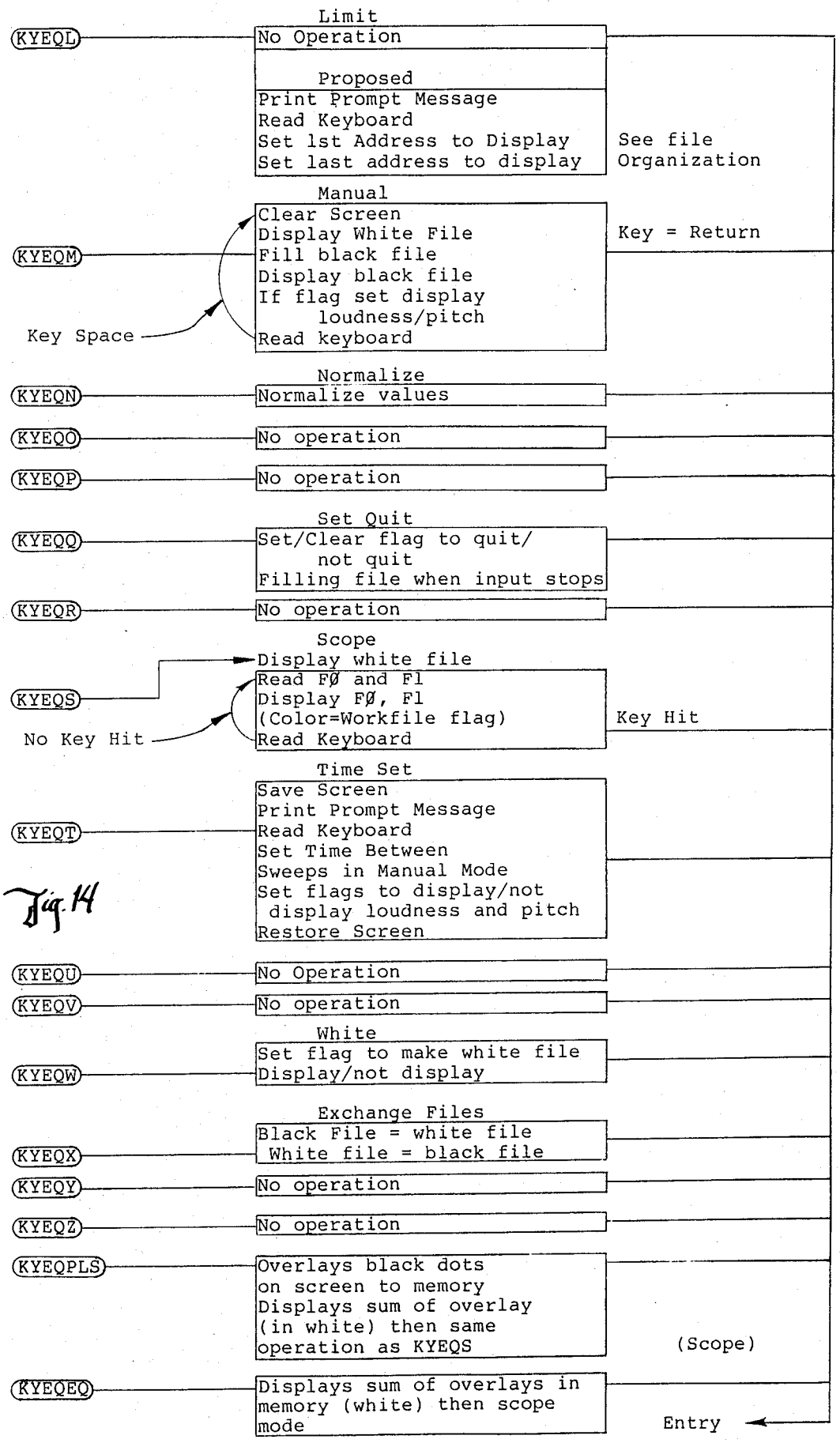

FIG. 12 is a flow chart schematic of the various commands which the computer 100 can read from the keyboard 105. FIGS. 13 and 14 are flow chart schematics which set out the operations of each of the commands.

Keyboard 105 is utilized to facilitate the entering of commands by the user to perform different display screen functions. A machine code program used with microprocessor 100 in the preferred embodiment is attached as an appendix to this Detailed Description of the Preferred Embodiment.

The plurality of formants (F0 to F2) shown in FIG. 1 are assigned as follows: Formant F0 passes frequencies 0 to 200 hertz; formant F1 passes frequencies from 0 to 850 hertz; and formant F2 passes frequencies 600 to 3000 hertz. These frequencies provide a continuous frequency spectrum with no gaps which would result in loss of information. The frequencies may be altered as is determined for the usefulness for various applications, and additional formants could be used. The frequencies of formants F1 and F2 were chosen to best represent the frequency space shown in the Fairbanks book, described above, where formant F1 and formant F2 are plotted orthogonally to define a location of voiced phonemes (see FIG. 4).

Characteristics of region and line slopes in this formant F1-formant F2 space produce information concerning unvoiced and semi-vowel phonemes. Formant F0 represents a characteristic of male, female and children's voices to enable the user to talk in a natural pitch suitable for the individual, while still rendering the orthogonal plot accurate. Loudness or intensity is a parameter which is monitored and displayed to teach deaf persons to speak in a normal "loudness" of voice.

The loudness parameter is derived from the inputted speech signal by tapping both sides of the AGC circuitry in between low pass filters 34 and 36 and amplifiers 38 and 40, as seen in FIG. 2. This signal is then amplified by amplifier 112, which is a summing amplifier, and then again boosted by amplifier 114, both also seen in FIG. 10. This loudness output is then inputted into A/D converter 103 which is then in a form for processing by microprocessor 100 which in turn outputs the now digitized loudness parameter to video terminal 102 for visual display on bar graph 110.

The particular flexibility of the invention relates to the ability of the system to display any of the different formants orthogonally with respect to each other, or any formant with respect to time, or loudness with respect to time. Additionally, the television display unit 102 allows for color enhanced displays which is particularly helpful when two sound traces are displayed concurrently so that they may be distinguished from one another.

FIG. 4 reveals graphically the principle of the speech analyzer. A speech input signal which is separated into two formants of the particular band widths represented by low pass and high pass filters 46 and 48, would create a trace similar to trace 28 or 29 of FIG. 1 correspondingly. Using the frequency range 0 to 850 hertz for the first formant and 600 to 3000 hertz for the second formant, Fairbanks determined that vowel sounds clustered in the area 94 of FIG. 4. According to his book, ideally voiced vowel sounds would be graphically located in the small circle areas 98, whereas allowing for regional accents and other speech variables the voiced vowel would land in the larger irregular areas 96.

The preferred embodiment of the present invention utilizes these band widths of formants F1 and F2, and additionally utilizes formant F0 and parameters such as loudness to analyze speech. It is to be pointed out though that different band widths and different numbers of formants can be used.

Figure 5A:
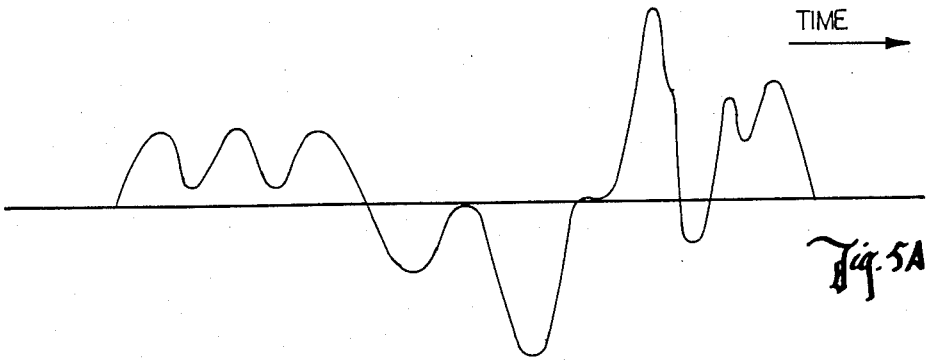
FIGS. 5A through 5D are wave forms useful in describing the operation of the sound analyzer circuitry.
Figure 5B:
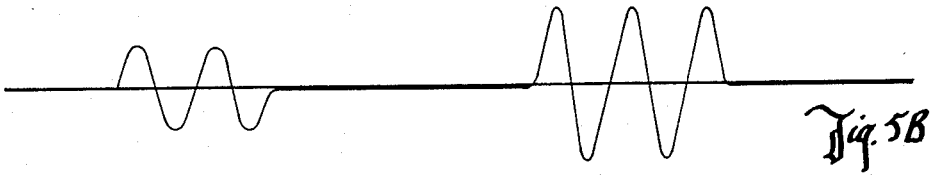
Figure 5C:
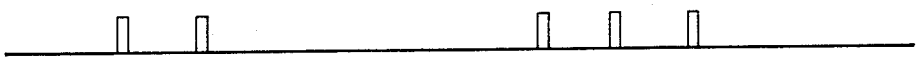
Figure 5D:
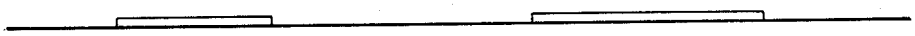

FIGS. 5A through D and FIGS. 6A through C show generally how the sound analyzer circuit 12 converts the speech signal into proportional voltages. FIG. 5A depicts a simplified general raw sound wave form such as might enter microphone 14. FIG. 5B is a representation of the signal that is derived from the raw wave form of FIG. 5A after it has been filtered by high pass filter 48 which passes the higher frequency content of the raw wave form. FIG. 5C shows how the signal shown in FIG. 5B is modified by frequency to voltage converter 56. A pulse of constant amplitude and short duration is generated by the frequency-to-voltage converter 56 upon every positive zero crossing of the signal shown in FIG. 5B. Thus, the time interval between the pulses is a reflection of the frequency content of the signal of FIG. 5B. Finally, the signal of FIG. 5C is passed through low pass filter 60, which integrates the signal to present an averaged pulse representative of the signal of FIG. 5B. FIGS. 5B through 5D show that generally equal frequencies, regardless of amplitude, will produce equally spaced pulses from frequency-to-voltage converter 56, as shown in FIG. 5C. Low pass filter 60 will then produce a proportional voltage reflecting those equal frequencies by outputting pulses of equal amplitude, as shown in FIG. 5D. The length of the pulses of 5D correspond to the differing period of time which that particular frequency exists, as can be seen in FIG. 5C where two zero crossings produce two pulses for the first frequency cluster of 5B, and three zero crossings produce three pulses for the second cluster of FIG. 5B.

Figure 6A:
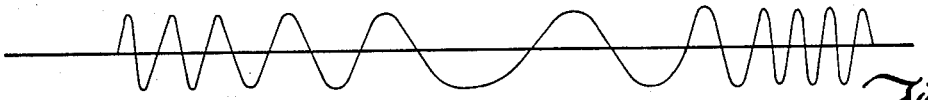
FIGS. 6A through 6C are additional wave forms useful in describing the operation of the sound analyzer circuitry.
Figure 6B:
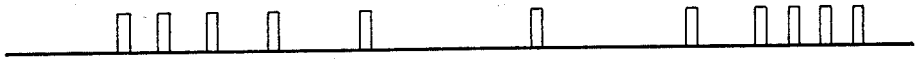
Figure 6C:
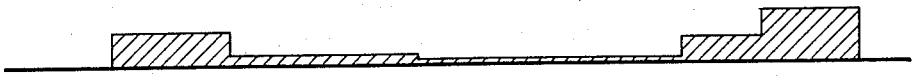

In comparison, FIGS. 6A through C show how a signal which has been filtered by high pass filter 48 and contains varying frequencies is converted into proportional voltages by frequency to voltage converter 56 and low pass filter 60. FIG. 6A shows the filtered signal from high pass filter 48. This signal is of constant amplitude, but contains varying frequencies. Frequency-to-voltage converter 56 emits a signal such as is shown in FIG. 6B. Again, the pulses are triggered upon every positive zero crossing of the signal of FIG. 6A. Thus, low pass filter 60 integrates the pulses of FIG. 6B to create the stepped pulses of FIG. 6C. These pulses of varying amplitude are the derived voltages proportional to the frequency content of the signal of FIG. 6A. This reveals how the frequency changes of FIG. 6A are almost instantaneously converted into proportional voltages which are used to produce the continuous real time trace 28 on television display 102.

Figure 7:
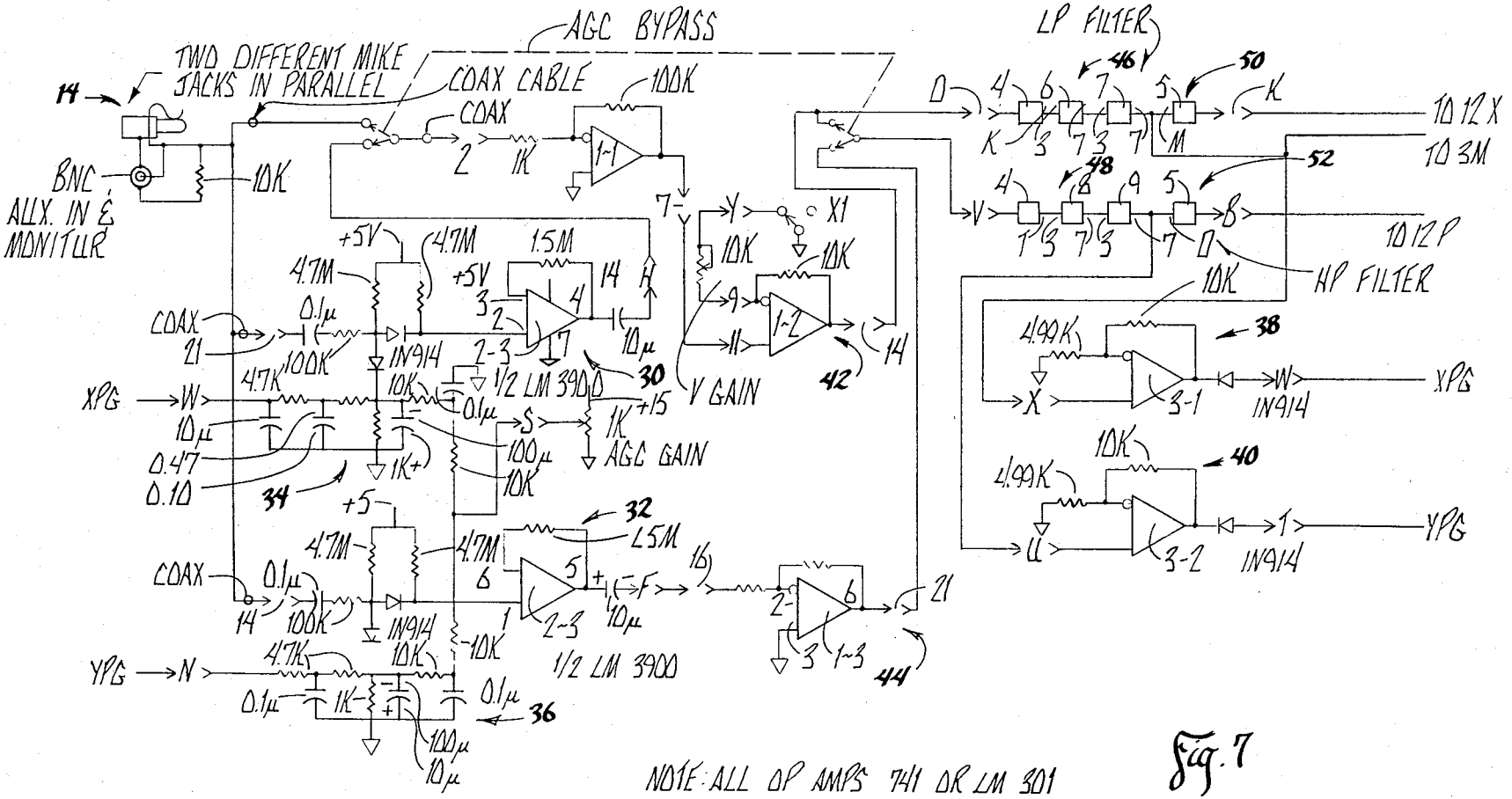
FIG. 7 is an electrical schematic of the input circuitry of the device.
Figure 8:
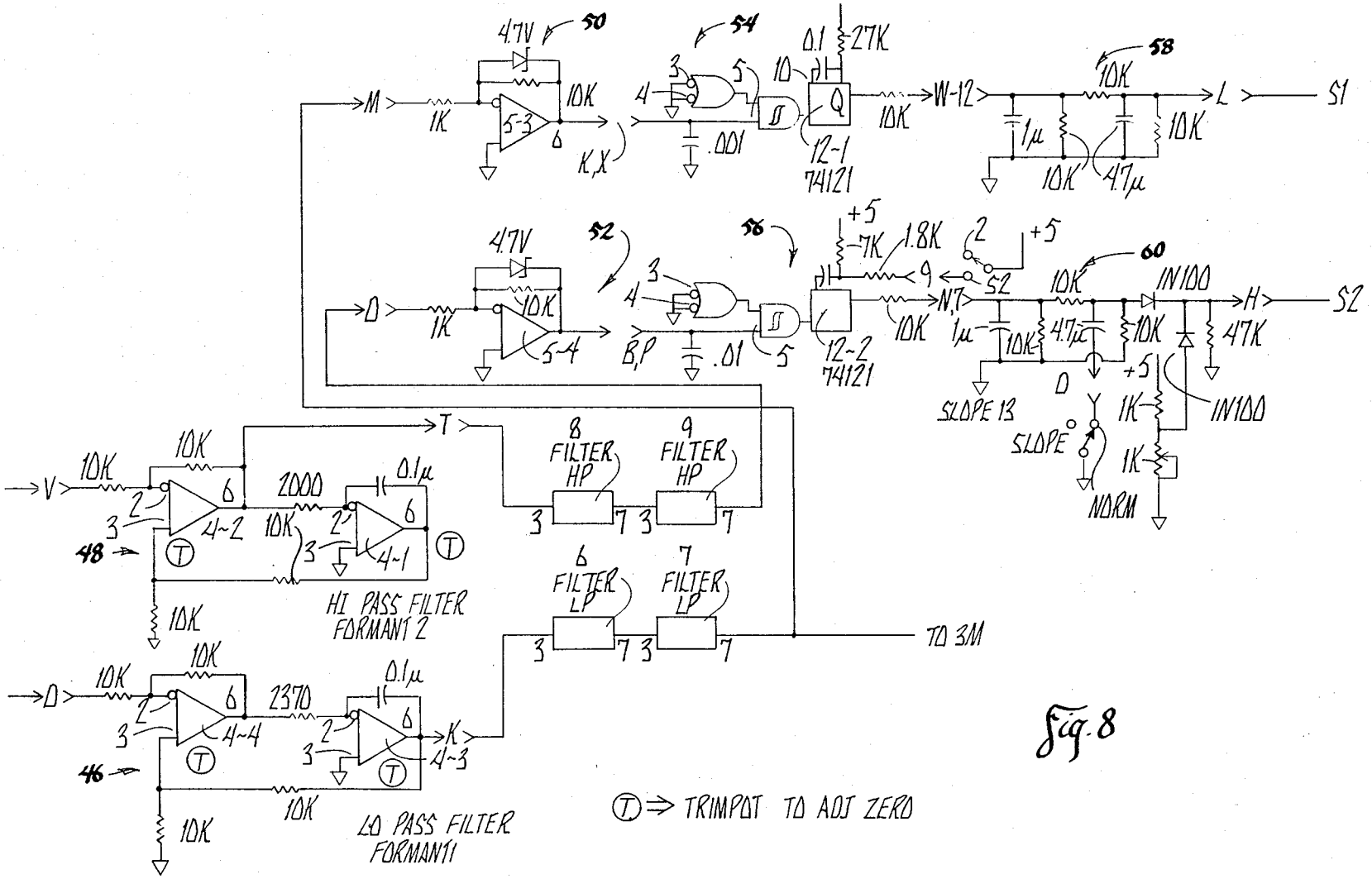
FIG. 8, is an electrical schematic of the formant filters and frequency to voltage converters of the device.
Figure 9:
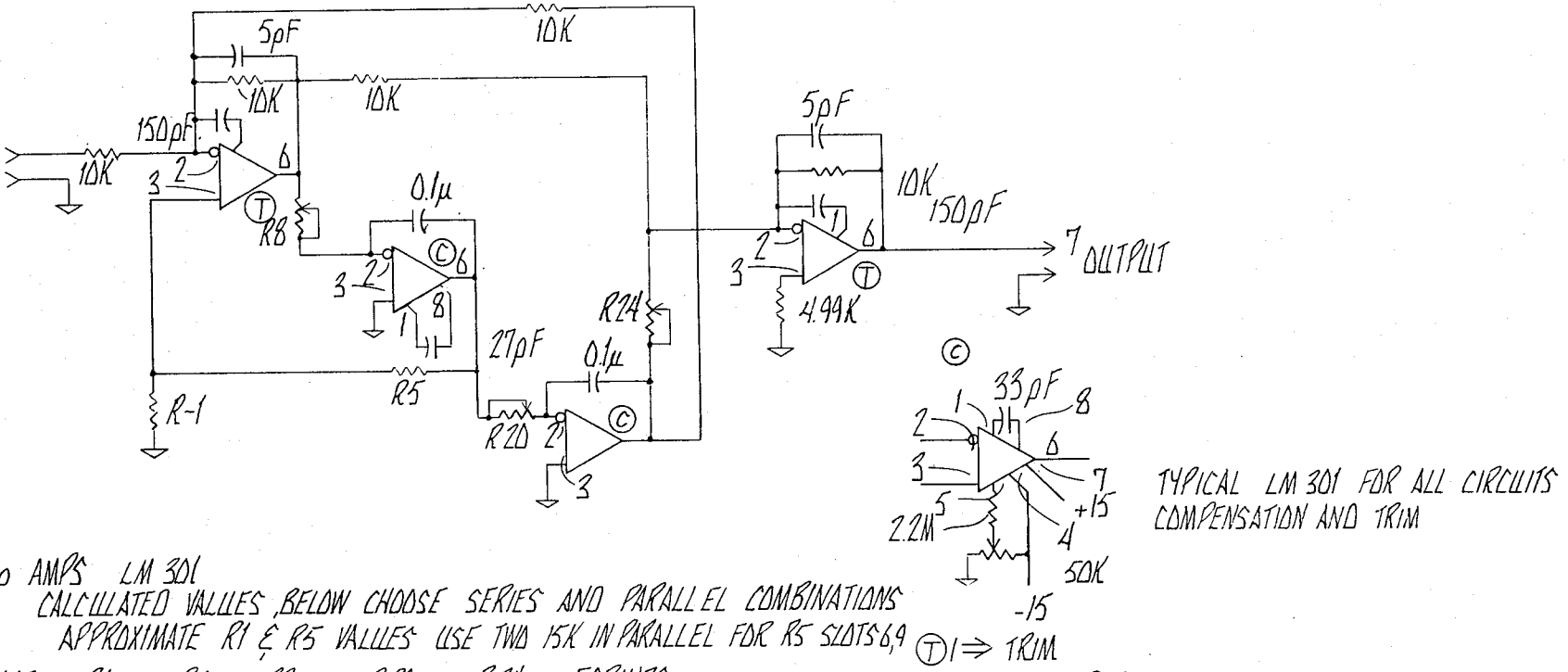
FIG. 9 is a more detailed electrical schematic of the filter circuits.
Figure 10:
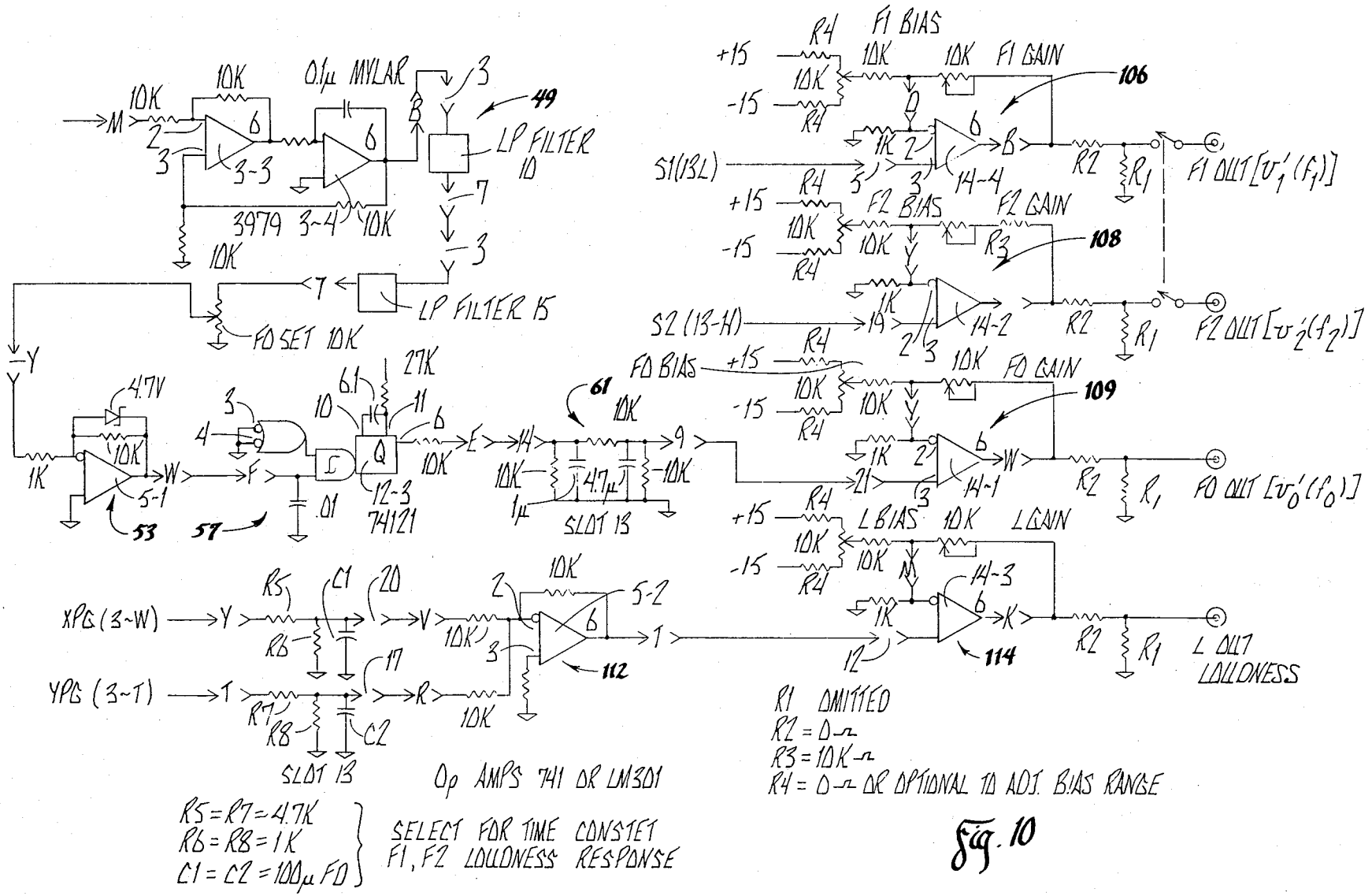
FIG. 10 is an electrical schematic of the output circuitry of the device.

FIGS. 7–10 illustrate certain circuitry for a specific embodiment of the invention. FIG. 7 shows the electrical schematic of the input circuitry which takes the spoken sound received by the microphone 14 and amplifies it for further processing. FIGS. 8 and 10 shows detailed circuitry for the formant filters 46, 48 and 49 which separate the inputted sound into different frequency formants, as depicted in FIGS. 5B and also the frequency to voltage converters 54, 56 and 57 which turn the frequency formants into proportional voltages as depicted in FIGS. 5D and 6C. FIG. 9 is an electrical schematic of a specific configuration of a filter such as filters 46, 48 and 49, which can be "tuned" to allow the passing of certain frequency formants. FIG. 10 also shows an electrical schematic of output circuitry for interfacing with small computer or microprocessor 100, whereby the frequency formants, now turned into proportional voltages, can be utilized to produce a visual display for speech therapy training.

The outputs of low pass filters 58, 60 and 61 are the integrated signals representing the frequency formants F1, F2 and F0, respectively. These signals in turn are sent through amplifiers 106, 108 and 109 which boosts the signals to present proportional voltages $V_1'(f_1)$, $v_2'(f_2)$, and $v_0'$ $(f_0)$, respectively. These proportional voltages have then been properly amplified for reception by A/D converter 103 of microprocessor 100.

In operation, the invention functions as follows:

A person speaks into microphone 14. The sound waves produced by the person's vocal chords are converted by the microphone into electro-mechanical signals representing the sound waves. In the preferred embodiment, these electromechanical signals are each introduced in parallel into a separate formant circuit. The first element of the formant circuits are AGC amplifiers 30 and 32. The electro-mechanical signal is inputted in parallel into the AGC amplifiers 30 and 32 which produce a signal of constant output which is referenced upon the output of filters 46 and 48. These signals are again amplified by amplifiers 1 and 2 (40 and 42) and then are introduced into formant filters 46 and 48. Filter 46 passes frequencies in the range of 0 to 800 hertz while filter 48 passes frequencies in the range of 600 to 3000 hertz. Therefore, the original speech has been divided into two frequency formants F1 and F2. Low pass filter 49 further filters the signal coming out of low pass filter 46 to produce formant F0 in the range of 0–200 hertz. Formants F0, F1 and F2 are amplified by amplifiers 50, 52 and 53, the resulting amplified frequency formants are then inputted into frequency-to-voltage converters 54, 56 and 57, which serve to produce proportional voltages derived from the frequency formants, as shown in FIGS. 5A through D, and FIGS. 6A through C. These resulting voltage formant signals are then integrated by low pass filters 58, 60 and 61, amplified by amplifiers 106, 108 and 109, and then passed to analog-to-digital converter 103 of small computer 100. Various modes and operations are then controlled by the software (see appended program) via commands entered from keyboard 105. The user then views traces 28 or 29 or both and optionally F0 and loudness 110, 111 on television 102.

The foregoing has disclosed a sound analyzer which has broad flexibility for use in the interpretation of sound. The preferred embodiment presents a visual display of loudness, frequency and pitch of voiced sounds in such a manner to allow study and interpretation of the characteristics of the speech. Display may then be used as a means of feed-back for aurally handicapped persons. The circuitry is relatively simple and the components are comparatively readily available and affordable to a wide segment of the population, thereby increasing the potential for availability of such devices to those who need them.

For example, several modes of display are available:

(1) "S" scope mode: A dot indicates the position relative to F1 and F2.

(2) "M" Manual mode: The trace of a voiced word is saved on the screen in black until reset for next try.

(3) "A" Automatic Mode: Same as manual, except the trace is present for a preset length of time, then the system is armed for listening and presentation of the next word voiced.

(4) "C" Calibrate Mode: all four input values are numerically displayed to adjust BIAS controls on the sound analyzer to base values.

In any mode, S,M,A, a background trace may be presented in white for comparison with the black trace. In the scope mode the white dots are eliminated if the black dots impinge on them.

The display is a sequence of dots representing F1 and F2 values as they occur in chronological order. The rate at which the dots are presented may be altered from the keyboard. This representation allows the instructor to point out various phenome locations in a voiced word as it is displayed in "slow motion".

The data may be filtered (averaged) by selections of values to present a smoothed curve. The black (foreground) or white (background) traces may be made invisible by command. The vertical and horizontal scales may be expanded to increase resolution in some areas. A help mode will list for the operator the various functions available.

In normal operation, the device listens for the word to start, takes data until the word ends and then plots the points. A no quit on quiet will cause the data to be taken from the time the word starts until the file is full. This further allows the display of a voiced word "baseball" which would normally terminate after the word "base".

The black and white files may be interchanged at any time to establish a new background file.

A black trace (foreground) may be added to a memory file at any time. The memory file can be displayed to show the sum of many tries of the student, or his complete voice range which has been stored.

Formant zero (pitch) can be displayed as a vertical bar on the right side of the screen for automatic and manual modes.

Loudness can be displayed as a horizontal bar on the bottom of the screen for automatic and manual modes.

The above description is understood to be a disclosure of only the preferred embodiments of the invention and alterations and modifications within the scope of the invention may be made.

What is claimed is:

1. A real time speech analyzer and display, comprising:

a first circuit for analyzing sound and including means for receiving sound input and for dividing said sound input into a plurality of frequency ranges, said ranges being continuous and partially overlapping so that there are no gaps between said frequency ranges, each said frequency range containing a frequency formant for said sound input;

converting means in said circuit for converting said sound input in said frequency ranges to proportional voltages representing the frequency content of said sound;

a microprocessor circuit for processing the voltages from the converting means and including analog to digital converting means for converting the voltages to digital signals, said microprocessor circuit being adaptable for operative use with software programming means for performing a plurality of processing operations on the digital signals;

a second circuit connecting said first circuit and said microprocessor circuit for conveying all of the voltages from said converting means to said microprocessor circuit, said voltages representing the sound input contained in said continuous, partially overlapping frequency ranges;

a display means connected to said microprocessor circuit for visually presenting traces derived from the output of said microprocessor circuit and representing said sound input; and a control means operatively connected to said microprocessor circuit and said display means for controlling the display of said traces.

2. The device of claim 1 wherein said display means displays continuous, real-time traces representative of said input sound, said traces being derived from one or more of said frequency formants.

3. The device of claim 1 wherein said microprocessor circuit includes signal processing means and operably associated software programming enabling said sound analyzer and said display means to interact to present a plurality of visual displays for analyzing said sound.

4. The device of claim 3 wherein said microprocessor circuit has memory storage means, time delay means, and means for processing a plurality of sounds sequentially through said circuit.

5. The device of claim 3 wherein said microprocessor circuit is controlled by keyboard means.

* * * * *